US011081842B2

(12) United States Patent
Wu et al.

(10) Patent No.: US 11,081,842 B2
(45) Date of Patent: Aug. 3, 2021

(54) ELECTRICAL CONNECTOR EQUIPPED WITH STABILIZED SHIELDING PLATE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Xiang Wu, Kunshan (CN); Yin-Chao Xu, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/742,922

(22) Filed: Jan. 15, 2020

(65) Prior Publication Data

US 2020/0235530 A1 Jul. 23, 2020

(30) Foreign Application Priority Data

Jan. 23, 2019 (CN) ..... 201920116839.X

(51) Int. Cl.
*H01R 13/6585* (2011.01)

(52) U.S. Cl.
CPC ..... *H01R 13/6585* (2013.01)

(58) Field of Classification Search
CPC ..... H01R 13/6585
USPC ..... 439/607.05, 607.08–607.11
See application file for complete search history.

(56) References Cited

U.S. PATENT DOCUMENTS

| | | | | |
|---|---|---|---|---|
| 5,403,206 | A * | 4/1995 | McNamara | H01R 13/6585 439/607.11 |
| 5,772,472 | A * | 6/1998 | Beutler | H01R 13/6585 439/607.08 |
| 6,220,896 | B1 * | 4/2001 | Bertoncini | H01R 13/6585 439/607.1 |
| 6,726,492 | B1 * | 4/2004 | Yu | H01R 23/688 439/108 |
| 9,263,835 | B2 * | 2/2016 | Guo | H01R 13/6596 |
| 9,385,482 | B2 * | 7/2016 | Li | H01R 13/6585 |
| 9,577,385 | B1 * | 2/2017 | Lin | H01R 13/74 |
| 9,853,399 | B2 * | 12/2017 | Kao | H01R 13/6585 |
| 9,917,405 | B2 * | 3/2018 | Ju | H01R 13/6583 |
| 10,103,501 | B2 * | 10/2018 | Lin | H01R 12/7005 |
| 10,153,596 | B2 * | 12/2018 | Lin | H01R 12/7005 |

(Continued)

FOREIGN PATENT DOCUMENTS

CN 109994894 A 7/2019

*Primary Examiner* — Gary F Paumen
(74) *Attorney, Agent, or Firm* — Ming Chieh Chang; Wei Te Chung

(57) ABSTRACT

An electrical connector includes an insulative housing and two rows of contacts retained in the housing, and a metallic shielding plate assembled in the housing and located between the two rows of contacts wherein the shielding plate includes a pair of spring fingers extending from the front edge into the mating cavity in front of the shielding plate, and a plurality of notches located around the pair of spring fingers and equipped with barbed structures extending into the notches so as to grasp the corresponding ribs of the housing so as to stabilize the whole shielding plate in the housing.

20 Claims, 9 Drawing Sheets

(56) References Cited

U.S. PATENT DOCUMENTS

| | | | | |
|---|---|---|---|---|
| 10,297,955 | B2 * | 5/2019 | Zhu | H01R 12/716 |
| 10,333,255 | B2 * | 6/2019 | Zhang | H01R 13/6594 |
| 2015/0072546 | A1 * | 3/2015 | Li | H01R 13/6585 439/96 |
| 2015/0244118 | A1 * | 8/2015 | Lin | H01R 13/426 439/357 |
| 2017/0194748 | A1 * | 7/2017 | Peng | H01R 13/6585 |
| 2017/0294746 | A1 * | 10/2017 | Fang | H01R 24/60 |
| 2018/0151985 | A1 * | 5/2018 | Zhang | H01R 13/6585 |

* cited by examiner

ELECTRICAL CONNECTOR EQUIPPED WITH STABILIZED SHIELDING PLATE

BACKGROUND OF THE DISCLOSURE

1. Field of the Disclosure

The present disclosure relates to an electrical connector, and particularly to the electrical connector equipped with a metallic shielding plate having stabilized structure beside the pair of spring tangs which are rearwardly deflected during mating.

2. Description of Related Arts

U.S. Pat. No. 10,333,255 discloses the receptacle connector for receiving a plug connector wherein the shielding plate is located between two rows of contacts and equipped with a pair of spring tangs in a front edge for confrontation with the mated plug connector, and barbed structures on two lateral edges for retaining the whole shielding plate in position within the housing. Anyhow, because the barbed structures are relatively far away from the spring tangs, the shielding plate tends to be tilted during mating with the plug connector.

An improved connector is desired to have the stabilized shielding plate so as not to be tilted during mating with the plug connector.

SUMMARY OF THE DISCLOSURE

An object of the invention is to provide an electrical connector with an insulative housing and two rows of contacts retained in the housing, and a metallic shielding plate assembled in the housing and located between the two rows of contacts wherein the shielding plate includes a pair of spring fingers extending from the front edge into the mating cavity in front of the shielding plate, and a plurality of notches located around the pair of spring fingers and equipped with barbed structure extending into the notches so as to grasp the corresponding ribs of the housing so as to stabilize the whole shielding plate in the housing.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
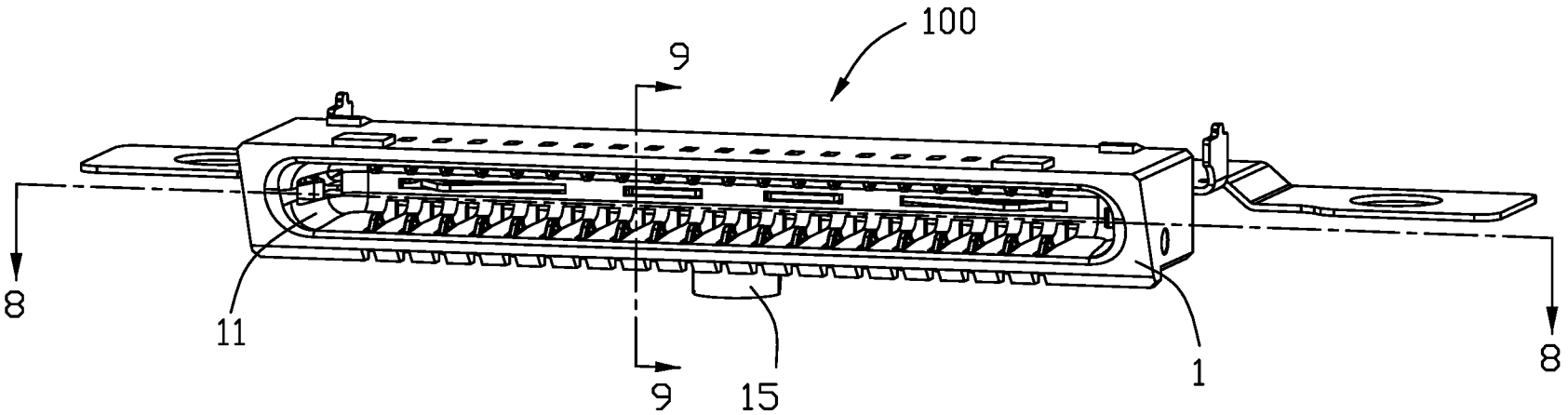
FIG. 1 is a perspective view of an electrical connector of the invention.
Figure 2:
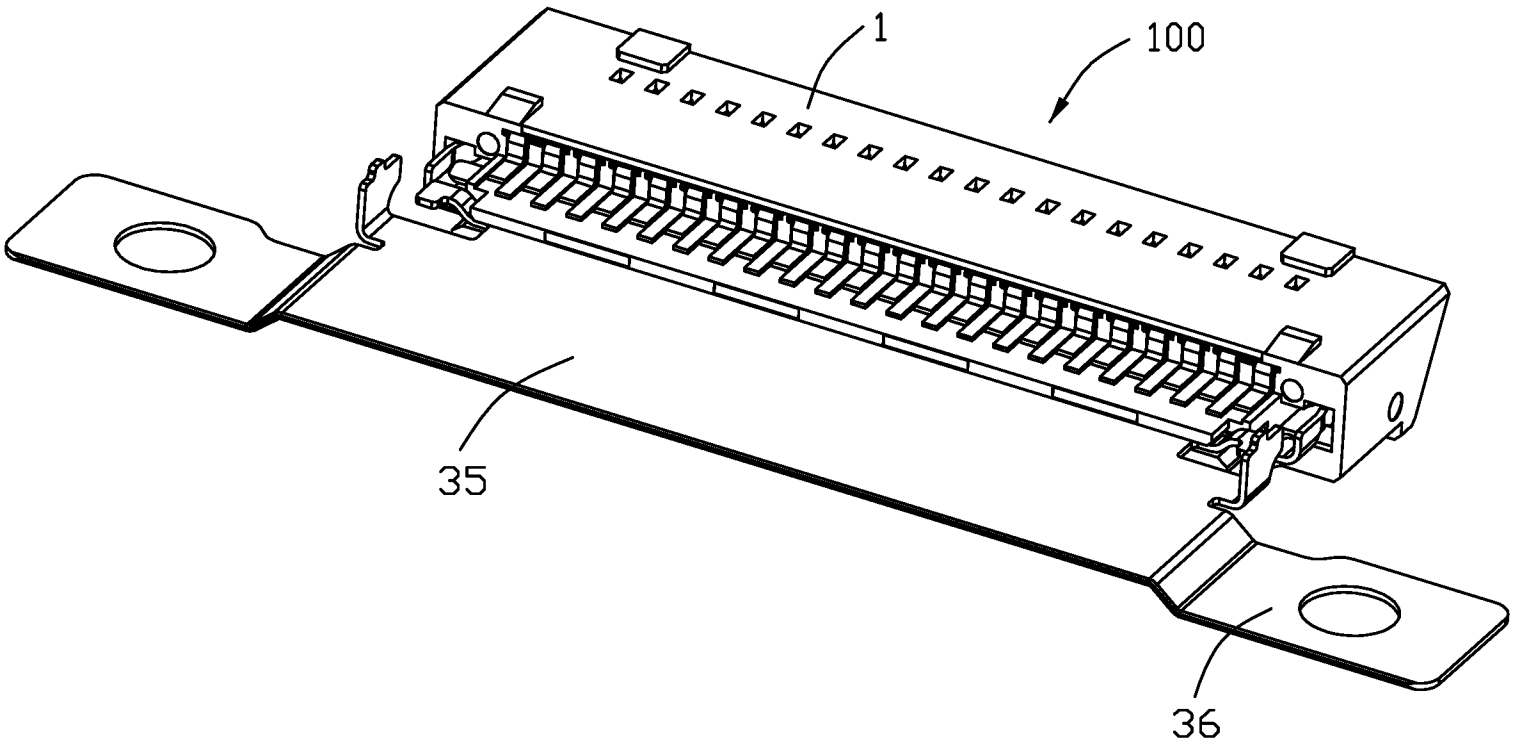
FIG. 2 is another perspective view of the electrical connector of FIG. 1.
Figure 3:
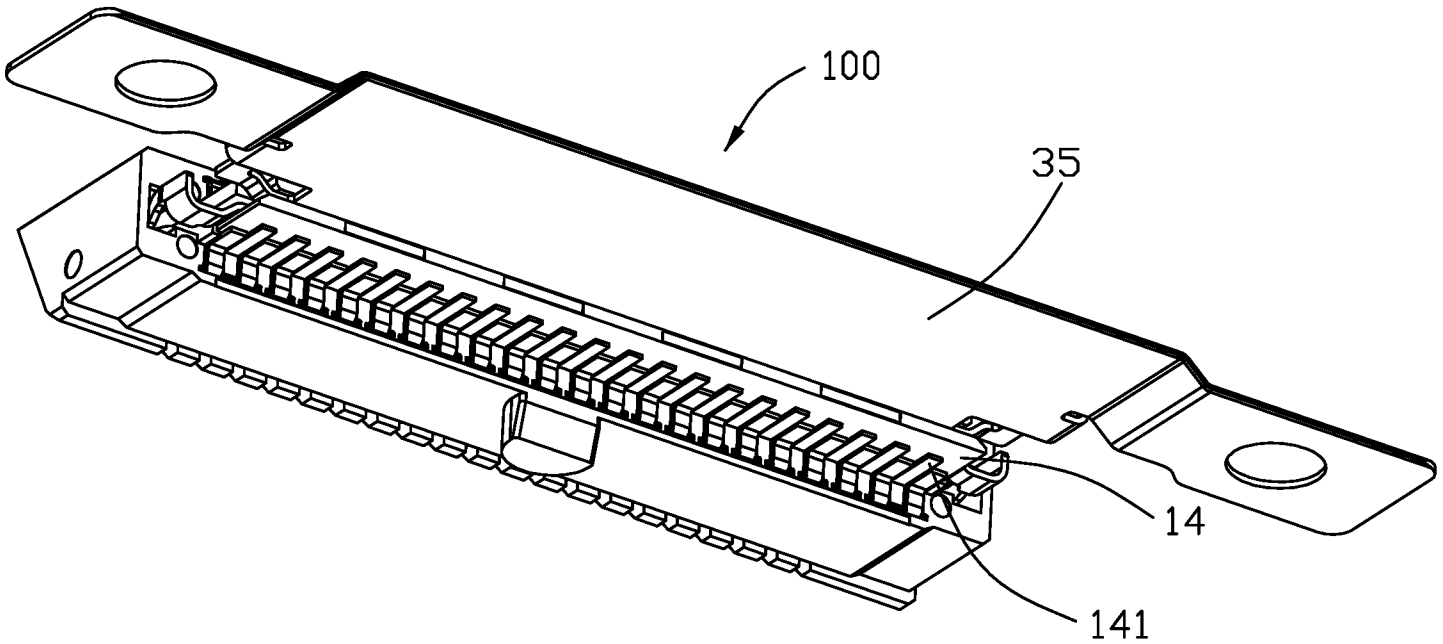
FIG. 3 is another perspective view of the electrical connector of FIG. 1.
Figure 4:
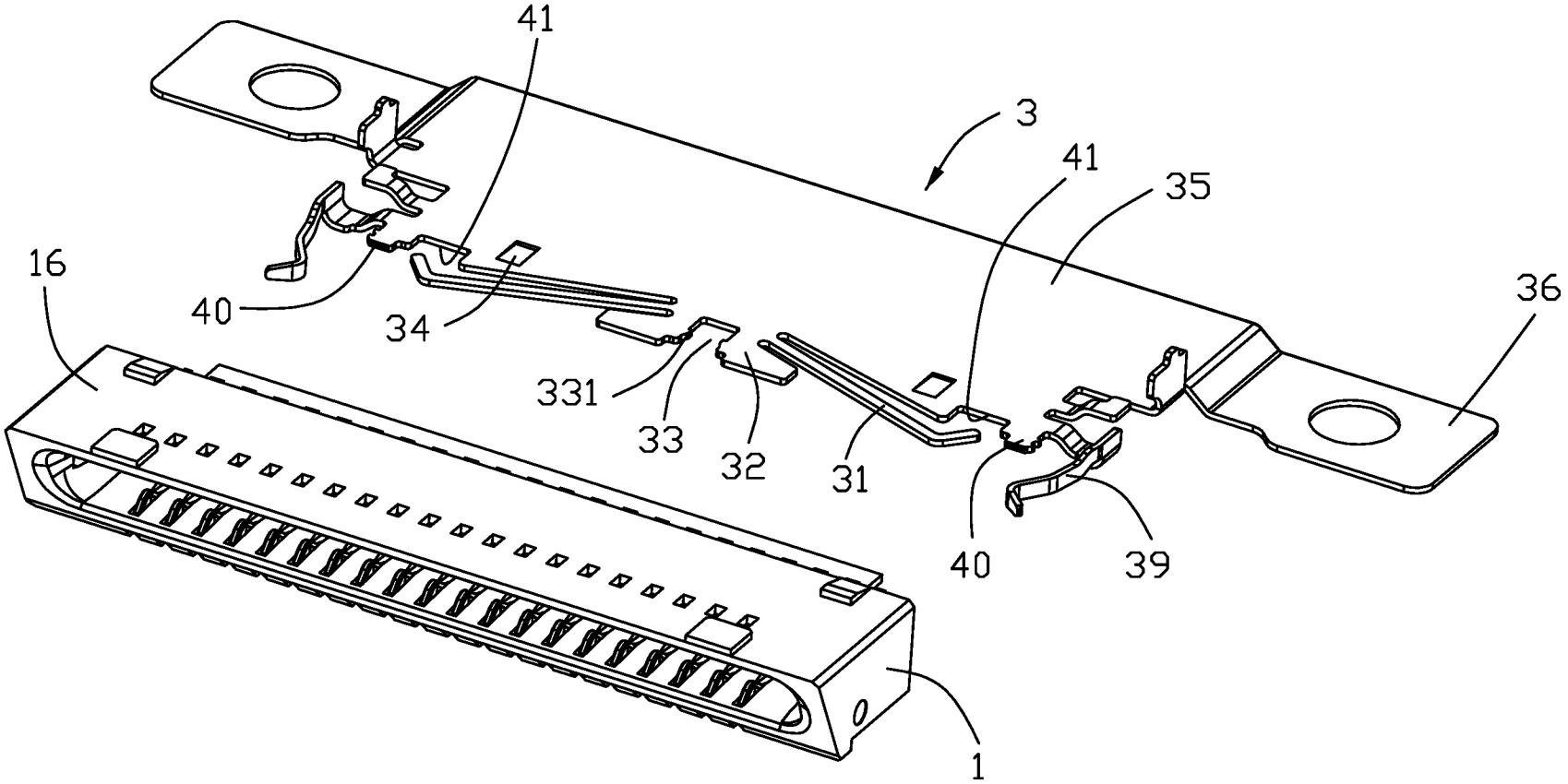
FIG. 4 is an exploded perspective view of the electrical connector of FIG. 1.
Figure 5:
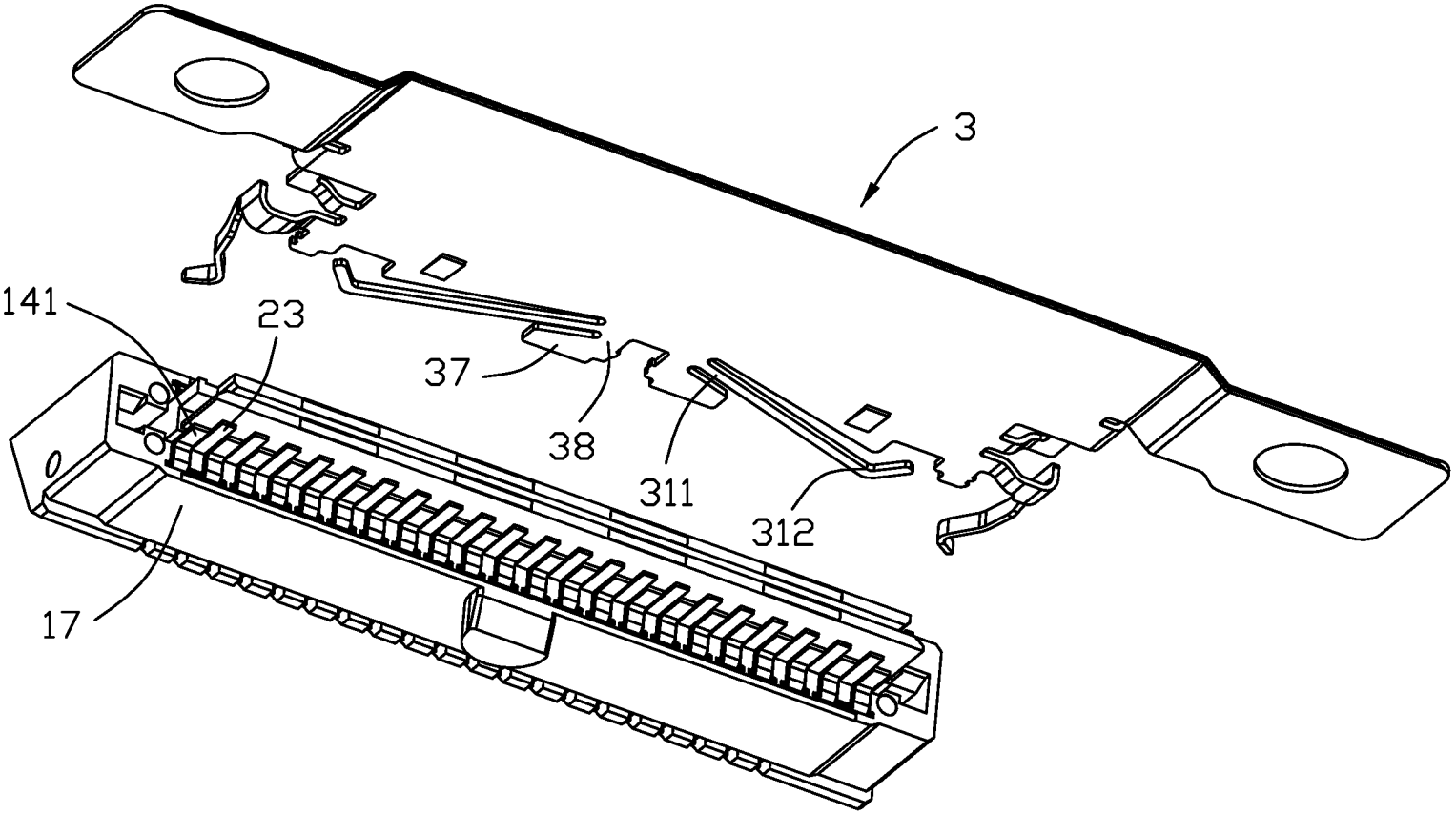
FIG. 5 is another exploded perspective view of the electrical connector of FIG. 4.
Figure 6:
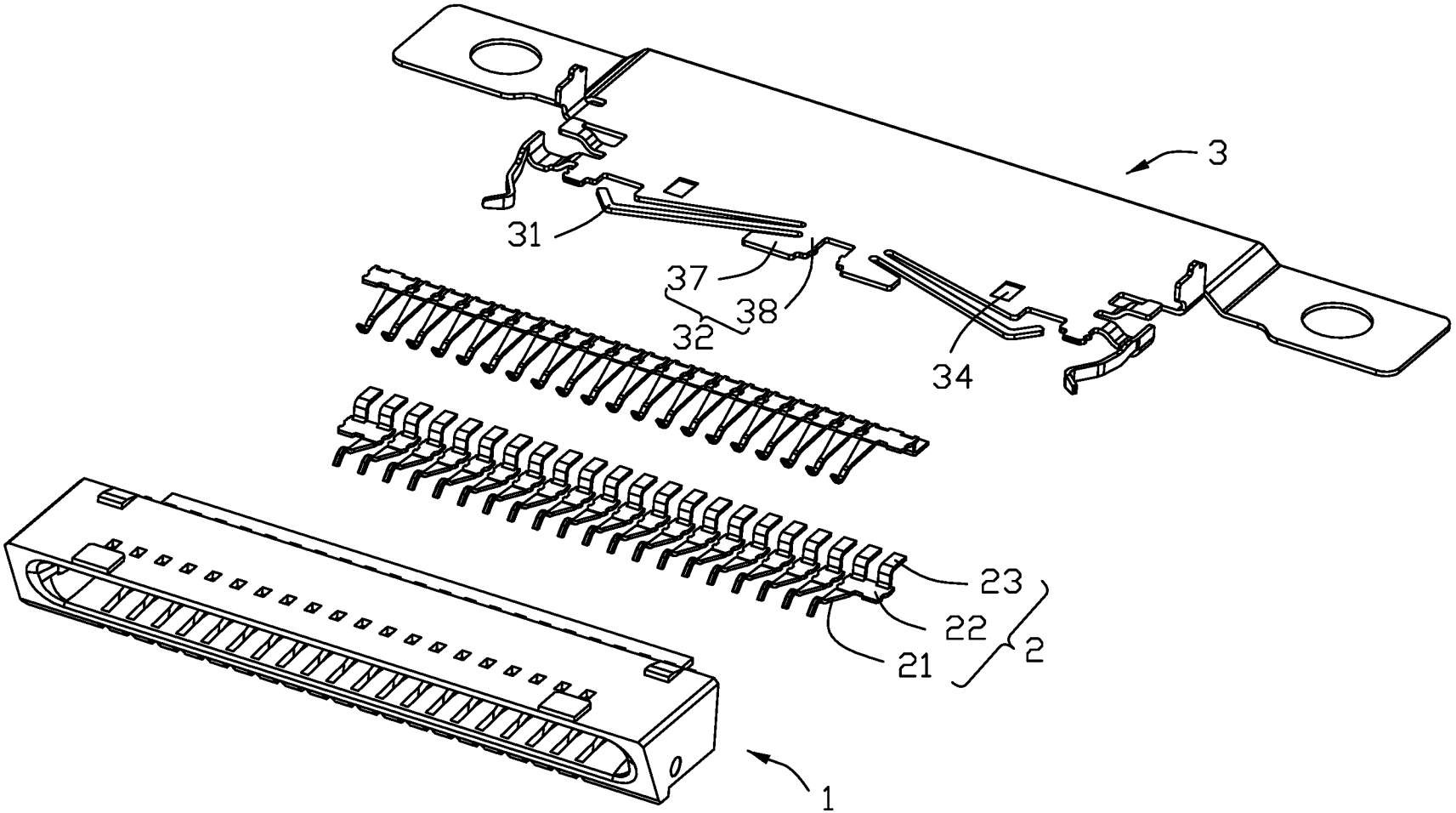
FIG. 6 is a further exploded perspective view of the electrical connector of FIG. 5.
Figure 7:
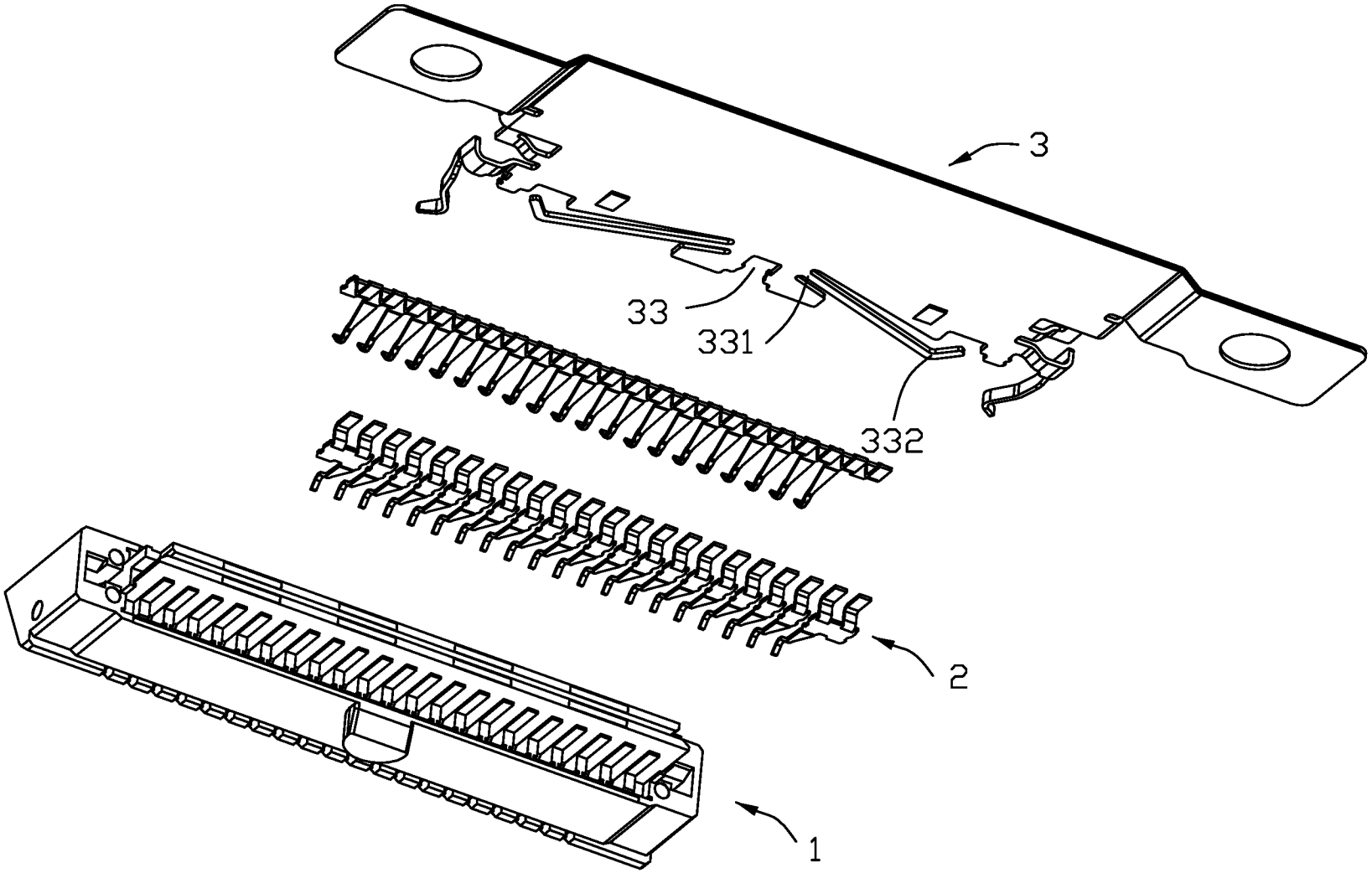
FIG. 7 is another exploded perspective view of the electrical connector of FIG. 3.
Figure 8:
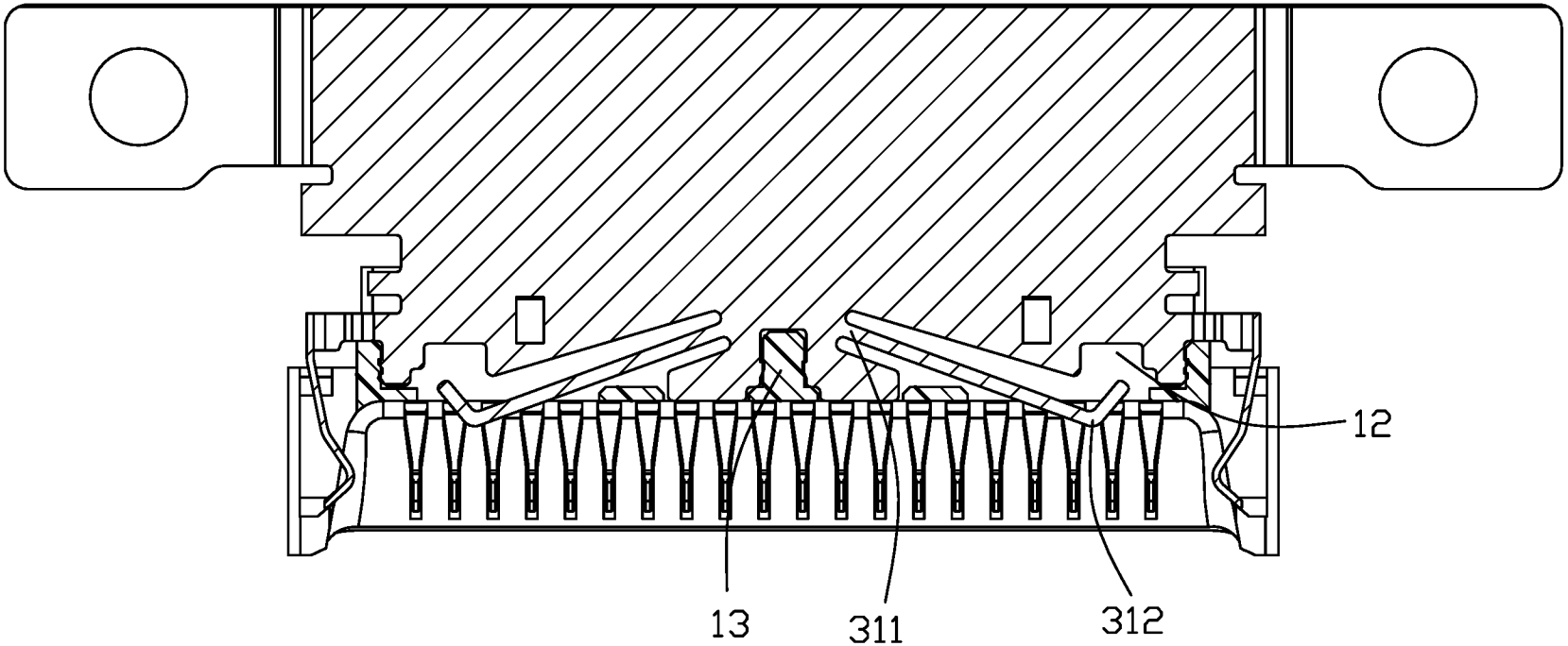
FIG. 8 is a cross-sectional view of the electrical connector of FIG. 1 along line 8-8.
Figure 9:
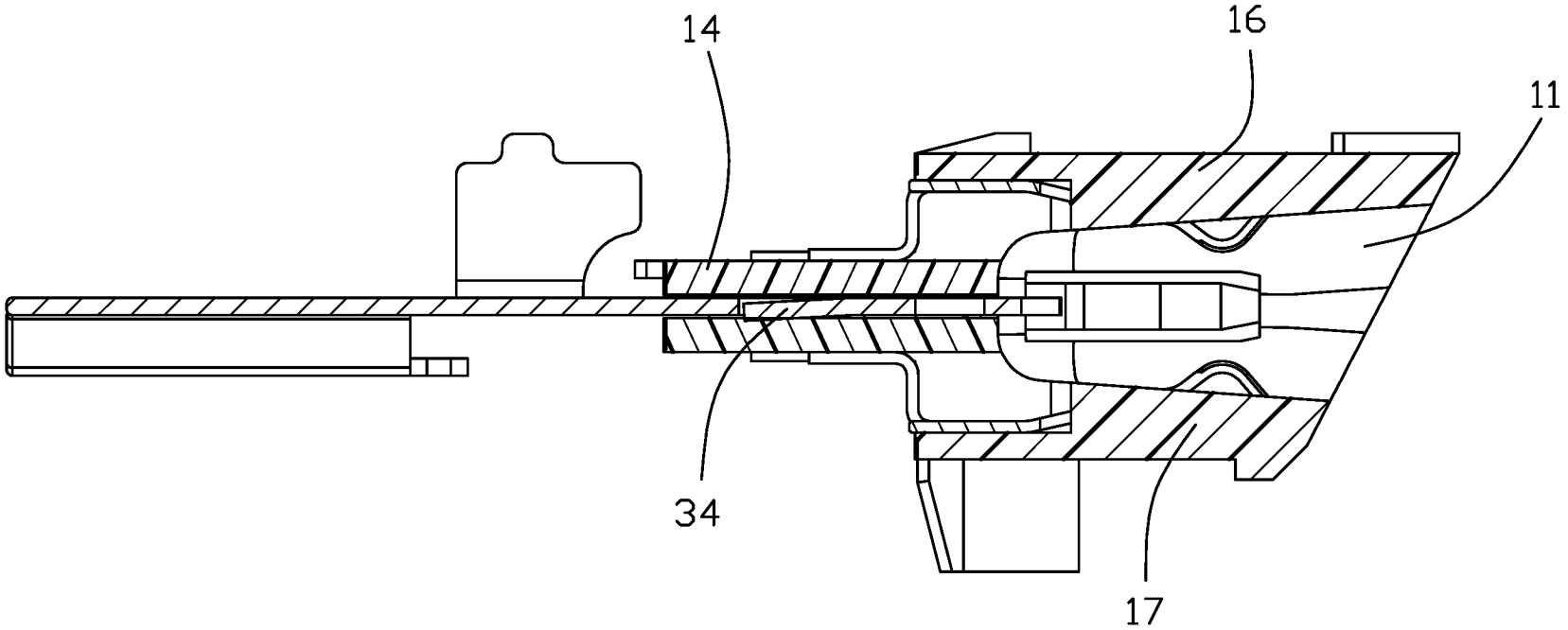
FIG. 9 is another cross-sectional view of the electrical connector of FIG. 1 along line 9-9.

Referring to FIGS. 1-9, an electrical connector 100 includes an insulative housing 1, two rows of contacts 2 assembled tot the housing 1, a metallic shielding plate 3 assembled into the housing 1. The housing 1 includes a mating cavity 11 and a horizontal insertion slit 12 behind the mating cavity 11 in a front-to-back direction. The contact 2 includes a front contacting section 21 extending into the mating cavity 11, a middle securing section 22 retained to the housing 1, and a rear connecting section 23. The shielding plate 3 is retained to the housing 1 and located between the two rows of contacts 2 in the vertical direction perpendicular to the front-to-back direction. A pair of spring fingers 31 extend forwardly and obliquely around a front edge of the shielding plate 3 and into the mating cavity 11. The pair of spring fingers commonly form a V like configuration in a top view. The shielding plate includes a dovetail like retention section 32 and the pair of spring fingers 31 are located by two sides of the retention section 32. The retention section 32 forms a notch 33 with barbed structures 331 therein so as to interfere with the rib 13 of the housing 1. The rib 13 is formed within the insertion slit 12 and linked between the opposite top and bottom face of the housing around the insertion slit 12 so as to reinforce the housing 1 around the insertion slit 12.

The retention section 32 includes a pair of wings 37 each having a tail section 38 behind the wings 37. The notch 33 is formed between the pair of wings 37. In fact, the barbed structures 331 are formed on the corresponding wing 37 to extend into the notch 33. Each spring finger 31 has a root section 311 extending from the corresponding tail section 38, and an abutment section 312 extending out of the insertion slit 12 and into the mating cavity 11 for confrontation with the mating plug connector (not shown). A plurality of interfering tabs 34 extend slightly obliquely extend within the insertion slit 12 for providing interference with the housing 1.

The notch 33 includes a wide part 332 and a narrow part 333 behind the wide part 332 to commonly form a T-shaped configuration for complying with that of the rib 13.

The shielding plate 3 includes a plate 35 behind the retention section 32 and the spring fingers 31, and a pair of mounting ears 36 at two opposite longitudinal ends of the plate 35 in the longitudinal direction perpendicular to the front-to-back direction and the vertical direction. The shielding plate further includes a pair of spring latches 39 located around the opposite ends of the plate 35 and forwardly extending into the mating cavity 11. The housing 1 includes a pair of rearwardly extending supporting platform 14 with the receiving slot 12 therebetween in the vertical direction. Each supporting platform 14 forms a plurality of standoffs 141 defining a plurality of grooves therebetween to receive the connecting sections 23 of the corresponding contacts 2, respectively.

The housing 1 includes opposite top wall 16 and bottom wall 17 to respectfully retain the two rows of contacts 2, and a semicircular protrusion 15 is formed on the bottom wall 17. In this embodiment, the shielding plate further includes two lances 40, with barbed structures thereon, on two opposite lateral sides with two spaces 41 beside not only enhance resiliency of the lance thereof for not jeopardizing the housing during inserting the shielding plate 3 into the insertion slit 12, but also providing space in which the free end of the corresponding spring finger 31 can be freely moved during mating.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing defining a mating cavity communicating forwardly with an exterior along a front-to-back direction;

two rows of contacts retained in the housing and located by two sides of the mating cavity in a vertical direction perpendicular to the front-to-back direction;

an insertion slit formed in the housing and communicatively located behind the mating cavity in the front-to-back direction;

a metallic shielding plate forwardly inserted into the insertion slit from a rear side of the housing, said shielding plate including a plate, a retention section located at a middle section of a front edge region of the plate with a notch therein to form a pair of wings by two sides of the notch along a longitudinal direction perpendicular to both the vertical direction and the front-to-back direction, each wing forming barbed structures extending into the notch, a pair of spring fingers respectively extending forwardly and obliquely from tail sections of the corresponding wings, respectively, and into the mating cavity; and the housing includes a rib receive within the notch to interfere with the barbed structures by two sides in the longitudinal direction; wherein the shielding plate further includes a pair of lances having barbed structures thereof at two opposite longitudinal ends of the front edge region with corresponding spaces aside in the longitudinal direction, and a free end of the corresponding spring finger is received within the space when the spring finger is rearwardly deflected during mating; wherein the barbed structures of the lances are aligned with the barbed structures of the wings in the longitudinal direction.

2. The electrical connector as claimed in claim 1, wherein the shielding plate further unitarily includes a pair of spring latches extending from positions behind the corresponding lances in the front-to-back direction, respectively, and into the mating cavity.

3. The electrical connector as claimed in claim 1, wherein the shielding plate further includes a plurality of interfering tabs slightly obliquely extending in the front-to-back direction to enhance interference with the housing.

4. The electrical connector as claimed in claim 1, wherein the shielding plate further includes a pair of horizontal mounting ears at two opposite longitudinal ends along the longitudinal direction.

5. The electrical connector as claimed in claim 4, wherein each mounting ear forms a through hole therein in the vertical direction.

6. The electrical connector as claimed in claim 1, wherein the retention section forms a dovetail configuration in a top view.

7. The electrical connector as claimed in claim 1, wherein the spring finger extends forwardly beyond the corresponding wing aside in the front-to-back direction.

8. The electrical connector as claimed in claim 1, wherein the pair of spring fingers are arranged in a V-shaped configuration.

9. The electrical connector as claimed in claim 1, wherein the housing further includes a pair of supporting platforms on the rear side to support rear connecting sections of the contacts thereon, and a rear portion of the insertion slit is defined between the pair of supporting platforms in the vertical direction.

10. The electrical connector as claimed in claim 1, wherein the shielding plate further forms a pair of interfering tabs extending slightly obliquely with a vertical dimension slightly larger than a thickness of the insertion slit.

11. The electrical connector as claimed in claim 2, wherein the pair of spring latches extend initially outwardly in the longitudinal direction and successively forwardly in the front-to-back direction.

12. An electrical connector comprising:

an insulative housing defining a mating cavity communicating forwardly with an exterior along a front-to-back direction;

two rows of contacts retained in the housing and located by two sides of the mating cavity in a vertical direction perpendicular to the front-to-back direction;

an insertion slit formed in the housing and communicatively located behind the mating cavity in the front-to-back direction;

a metallic shielding plate forwardly inserted into the insertion slit from a rear side of the housing, said shielding plate including a plate, a front edge region of the plate including barbed structures formed on a middle position and two opposite longitudinal ends in a longitudinal direction perpendicular to the vertical direction and the front-to-back direction to retain the shielding plate to the housing at three spaced positions, and further including a pair of spring fingers extending from forwardly and obliquely between the barbed structures in the longitudinal direction and into the mating cavity; wherein said three spaced positions are aligned with one another in the longitudinal direction.

13. The electrical connector as claimed in claim 12, wherein the pair of spring fingers are arranged with a V like configuration.

14. The electrical connector as claimed in claim 13, wherein the front edge region of the plate forms a pair of spaces to receive free ends of the spring fingers when the spring fingers are rearwardly deflected.

15. The electrical connector as claimed in claim 14, wherein a pair of lances are formed by two sides of the pair of spaces in the longitudinal direction, and the shielding plate further unitarily includes a pair of spring latches located at the opposite longitudinal ends and extending from positions behind the corresponding lances in the front-to-back direction, respectively, and into the mating cavity.

16. The electrical connector as claimed in claim 12, wherein the front edge region of the plate forms a dovetail like portion at the middle position with a notch therein, and the corresponding barbed structures are formed in the notch.

17. The electrical connector as claimed in claim 16, wherein the housing forms a rib engaged within the notch.

18. The electrical connector as claimed in claim 12, wherein the housing further includes a pair of supporting platforms on the rear side to support rear connecting sections of the contacts thereon, and a rear portion of the insertion slit is defined between the pair of supporting platforms in the vertical direction.

19. The electrical connector as claimed in claim 12, wherein the shielding plate further forms a pair of interfering tabs extending slightly obliquely with a vertical dimension slightly larger than a thickness of the insertion slit.

20. The electrical connector as claimed in claim 15, wherein the pair of spring latches extend initially outwardly in the longitudinal direction and successively forwardly in the front-to-back direction.

* * * * *